United States Patent [19]

Pynsky

[11] 4,044,891

[45] Aug. 30, 1977

[54] CAN TESTING CONVEYOR

[75] Inventor: Raymond F. Pynsky, Barrington, Ill.

[73] Assignee: dun-Rite Erectors, Inc., Elk Grove Village, Ill.

[21] Appl. No.: 648,270

[22] Filed: Jan. 12, 1976

[51] Int. Cl.[2] ..... B07C 5/02

[52] U.S. Cl. ..... 209/73; 209/80; 198/339; 198/491

[58] Field of Search ..... 209/73, 74, 80, 82; 198/34, 339, 491

[56] References Cited

U.S. PATENT DOCUMENTS

| | | | |
|---|---|---|---|
| 2,606,657 | 8/1952 | Berthelsen | 209/82 X |
| 3,037,609 | 6/1962 | Steele et al. | 198/34 |
| 3,462,823 | 8/1969 | Heisler | 198/491 X |
| 3,480,140 | 11/1969 | Unkefer | 209/73 |
| 3,537,579 | 11/1970 | Roberson | 209/73 |
| 3,747,753 | 7/1973 | Flint | 209/73 |

*Primary Examiner*—Robert B. Reeves
*Assistant Examiner*—Joseph J. Rolla
*Attorney, Agent, or Firm*—Robert A. Brown; August E. Roehrig, Jr.

[57] ABSTRACT

A transporter for conveying articles through a testing or monitoring station. Movement of articles through the test station is controlled at predetermined spaced intervals, and the article is stabilized during monitoring to obtain accurate test data. A reject mechanism, operative in response to the monitoring of the object, is provided to eject any object which is determined to vary from predetermined test limits. The transporter is especially suitable for use in the food processing industry to monitor both positive and negative pressurized containers passing therethrough.

9 Claims, 5 Drawing Figures

CAN TESTING CONVEYOR

BACKGROUND OF THE INVENTION

This invention relates in general to on-line testing systems and, in particular, to a conveying system which controls the movements of articles through a testing or monitoring station.

More specifically this invention relates to a conveyor which may be readily interposed in an existing conveying line to control the movement of articles through a monitoring station and to remove those articles which vary from a predetermined test standard.

The problems encountered when conveying materials or articles through a production facility, and inspecting these materials as they pass through the production line or processing stations, are both many and varied. Attempted solutions to these problems have been as varied as the products being manufactured or the processes being employed. While this invention has general application in many production or processing systems, for convenience of illustration it will be described with reference to its use in the food processing industry which requires high speed and inexpensive transporting systems to handle canned goods as they are being processed.

In the processing of food stuffs, various comestibles or food products are prepared and a measured amount placed into a suitable container to be packaged in a manner which will preserve the food stuffs until such time as they are used by a consumer. Quality control and product purity are stringent requirements or standards which are imposed on the food processing industry to guard the health of the consumer. During the food packaging operation stringent quality control measures are taken to insure the integrity of both the product and the packaging. For example, in canning food stuffs the product is prepared and the cans are sterilized such that after a measured amount of food stuffs have been placed into the can and the can sealed, a negative pressure or vacuum is produced in order to maintain freshness of the product and prohibit the growth of oxygen requiring bacteria. If after such processing the vacuum within the can is lost, the can becomes a potential health hazard and causes serious economic loss to a distributor when the contents spoil during shipping or storage. Such cans frequently explode or expel their contents throughout the case in which they are packaged contaminating the other containers within the casing as well as surrounding materials.

Since testing of the cans to insure that a proper vacuum has been maintained is so important, various systems have been devised to monitor the cans to insure that a proper vacuum is present. Many of these prior art systems require that the cans be diverted from the processing line to an "off-line" monitoring station whereat the cans are tested and then placed back on line for further processing, such as labelling. While these systems have been somewhat satisfactory, an obvious problem associated with such systems is the diverting of the cans off the line to the testing station, and the reintroduction from the testing station back onto the processing line. As is well known to those skilled in this art, when cans are removed from the on-line conveying system and diverted to and from the testing station to go back on line, a substantial loss of time is incurred as well as frequent interruptions of the processing procedures due to jams occasioned at the diverting stations.

SUMMARY OF THE INVENTION

It is, therefore, an object of this invention to improve systems for transporting articles through a monitoring station for on-line testing.

Another object of this invention is to control the passage rate of articles through the test station to insure accurate test data uneffected by variations in the flow rate of the on-line products.

A further object of this invention is to control the passage of articles to be tested through the monitoring station.

Still another object of this invention is to control the movement of articles through the monitoring station to facilitate ejection of articles varying from predetermined test limits.

These and other objects are attained in accordance with the present invention wherein there is provided transport system for moving objects through a monitoring station at a predetermined rate of flow. The article to be monitored is maintained in a stabilized configuration during testing. A reject mechanism is provided to eject any item varying from predetermined test limits as monitored by the testing equipment.

DESCRIPTION OF THE DRAWINGS

Further objects of this invention, together with additional features contributing thereto and advantages accruing therefrom, will be apparent from the following description of one embodiment of the invention when read in conjunction with the accompanying drawings, wherein.

DESCRIPTION OF A PREFERRED EMBODIMENT

Figure 1:
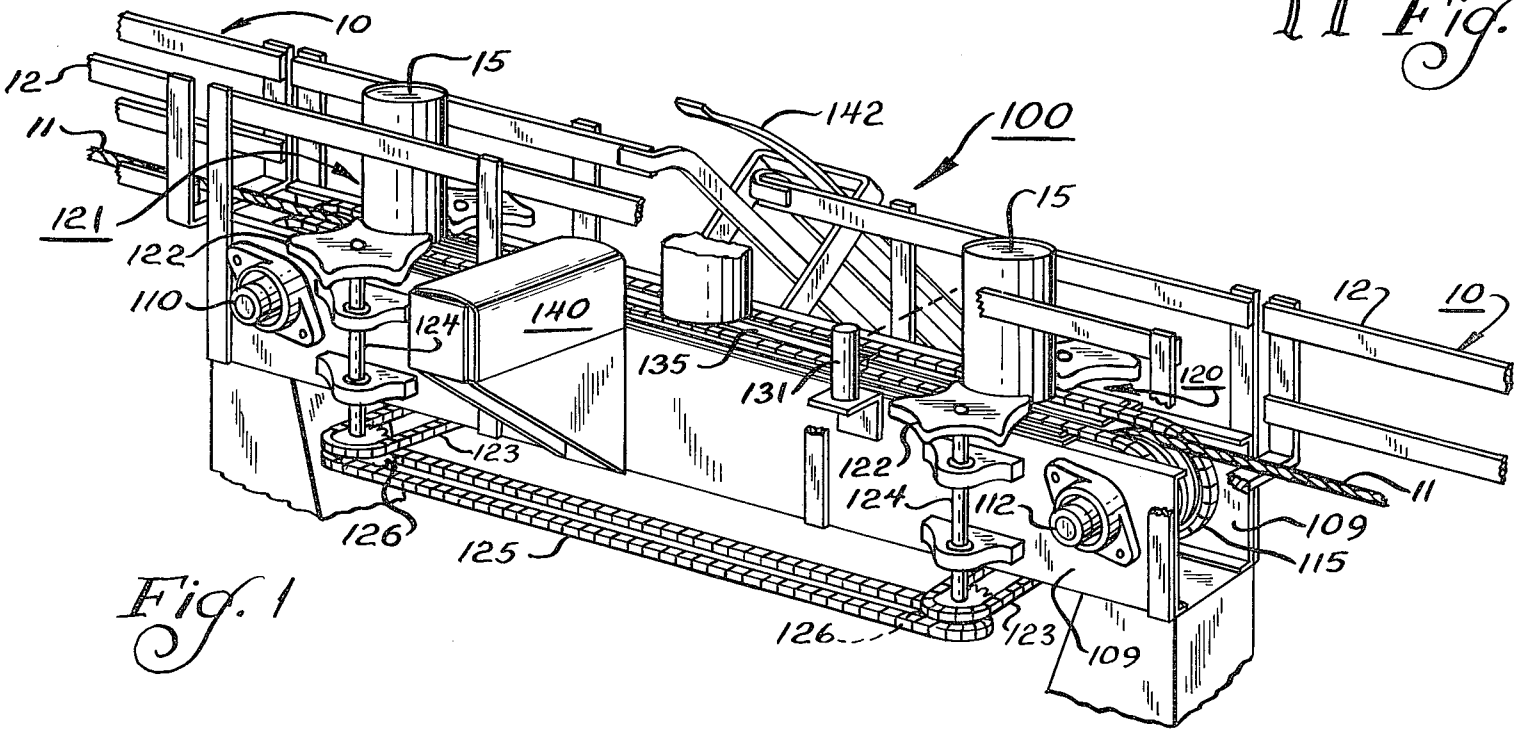
FIG. 1 is a frontal perspective view of the transporter system interposed in a food processing conveying system for on-line operation.
Figure 2:
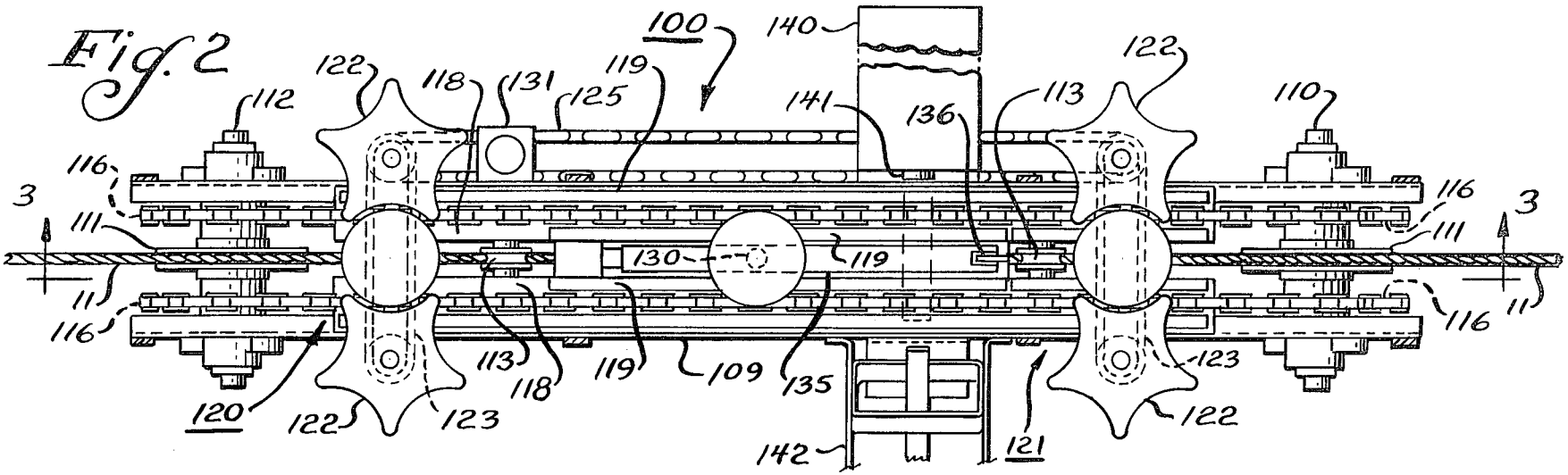
FIG. 2 is a horizontal planar view of the transporter system shown in FIG. 1 to better illustrate the on-line flow features and the testing unit.

Referring now to FIG. 1, the transporter 100 is shown interposed on-line in an existing can conveying system 10. The can conveying system 10, in which the transporter 100 is interposed, includes a conveyor cable 11 driven in an endless path of movement to convey cans 15 through processing stations from one point to another on the cable 11. The cans are supported during movement between parallel guard rails 12 to maintain the cans in an upright orientation.

The transporter 100 is interposed on-line in the conveying system 10 by removing a section from the existing conveyor approximately equal in length to the transporter 100. The conveyor cable 11 is passed over idler pulleys 111 carried by drive and driven shafts 110 and 112, respectively, of the transporter and beneath a pair of idler sheaves 113 supported from the transporter between the drive and driven shafts. Positioning of the conveyor cable 11 in this manner permits continuous operation of the cable independent of the operation of the transporter 100 by allowing the cable to pass through the transporter independently of the monitoring of each can which is described in detail hereinafter.

Since the idler pulleys 111 which support the conveyor cable 11 are carried upon the drive and driven shafts of the transporter unit, a can 15 passing along the conveyor 10 will be carried directly onto transporter chains 115 of the transporter 100 by the cable 11. The can will then be carried by the transporter chains 115 through the monitoring or test station and, if it is found to be within pre-set parameters, exit from the transporter 100 back onto the cable 11 to continue on-line with the conveying system 10 through the processing stations.

The transporter 100 includes a pair of spaced frame plates 109 carrying the drive and driven shafts 110 and 112 upon which the cable supporting idler pulleys 111 are mounted for free rotation relative thereto. The transporter chains 115, a pair of smooth flat drive chains, pass about sprockets 116 carried by both the drive and driven shafts for moving in two endless parallel paths of movement transporting the cans through the monitoring station. The chains 115 each are supported beneath by a support plate 118 and guided laterally between two spaced parallel guides 119 to insure proper tracking of the two transport chains, and precise support for the can bottom during transport through the monitoring station.

In order to insure accurate monitoring of the cans passing through the transporter 100, spaced intervals must be maintained between adjacent cans. A pair of star-wheel indexers 120 and 121, rotatably supported from the frame plates 109, are positioned at both the entrance to and exit from the transporter, respectively, to control spacing between the cans as they move through the monitoring station. The individual star wheels 122 of each pair are mechanically interlocked for movement together by means of a chain 123 passing about suitable sprockets secured to a shaft 124 upon which each star wheel is rotatably carried. Both pairs of the star-wheel indexers 120 and 121 are also mechanically interlocked to each other for synchronous movement. A chain 125 is connected to a sprocket 126 secured on one of the shafts 124 of each pair so that the rotational movement of one pair of indexing devices will simultaneously effect a like rotational movement of the other star wheel indexing pair.

As the cans 15 are conveyed by the conveyor system 10 onto the transporter 100, each can will pass between the entrance indexing device 120 (one can is shown in each of the entrance, testing, and exit positions) to control the spacing interval between adjacent cans. In the event that cans accumulate at the entrance to the transporter 100, the star-wheel indexer 120 at the entrance will maintain a spacing between the cans by controlling entry to the monitoring station insuring accurate test results. Similarly if the cans cannot be passed from the transporter 100 back onto the conveying system 10, due for example to accumulation of cans on the conveyor at the exit from the transporter, the mechanical coupling of both pairs of the indexing devices will prevent rotation of the indexing device 120 at the entrance thereby blocking additional cans from entering the transporter into the testing position. Such mechanical interlocking will control the inter-can spacing at all times insuring that the integrity of can spacing is maintained.

Spacing between cans must be maintained in order for a proximity sensor 130 to accurately monitor or test the pressure within the cans. When the can is in the proper position for pressure determination, inaccuracies caused by the can rim or ripples in the bottom of the can are eliminated by timing the generation of a test pulse from the proximity sensor 130 in relation to the position of the can on the transporter 100. Such timing of the test pulse in relation to the can position will insure that the test is taken at the same portion of each can.

Figure 4:
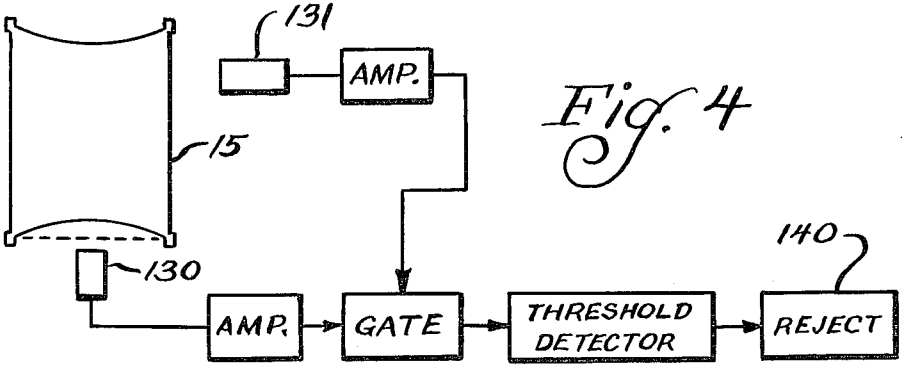
FIG. 4 is an electrical schematic block diagram of the monitoring equipment.

In order to time or gate the test pulse from the proximity sensor 130, a can detector 131 is adjustably carried on one of the frame members 109 for movement relative to the proximity sensor for varying the spacing therebetween. The can detector 131 is energized upon the passing of a can across the detector and, as shown in FIG. 4, generates a gating pulse to the proximity sensor. The gating pulse controls timing of the test pulse so that the test pulse will be generated when the center of the can is at the proximity sensor 130. Timing between the detecting of the presence of the can by the can detector 131 and gating the firing of the test pulse from the proximity sensor may be varied both electronically and by the physical positioning of the detector along the frame to provide a wide range of latitude for the detecting and monitoring system.

Figure 3:
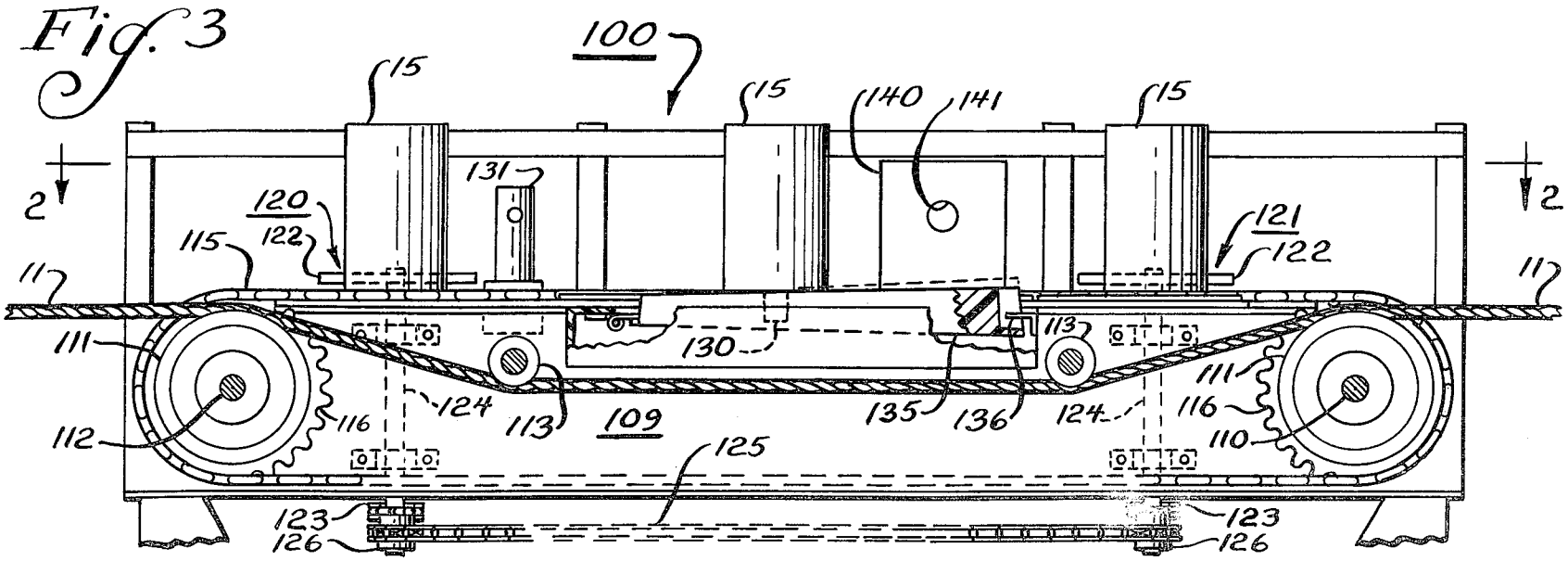
FIG. 3 is a sectional view of the transporter system of FIG. 2 with portions removed to better illustrate the features and components thereof.

The proximity sensor 130 which monitors the pressure in the cans is carried between the spaced parallel transporter chains 115 by a spring-biased pivotal support bar 135. The support bar 135 is pivoted at the leading end or entrance in an upward or counter-clockwise direction (FIG. 3) to provide a stabilizing platform for the can during testing. As a can is advanced to the proximity sensor 130 by the transport chains 115, it is conveyed onto the support bar 135 which is depressed by the weight of the can to overcome the spring bias. However, the spring biasing of the support bar against the bottom of the can is sufficient to provide stabilizing points for the can in addition to the support provided by the transport chains thereby helping to insure integrity of the test. An adjustable stop 136, at the trailing end or exit from the support bar, limits the upward movement of the support bar.

Figure 5:
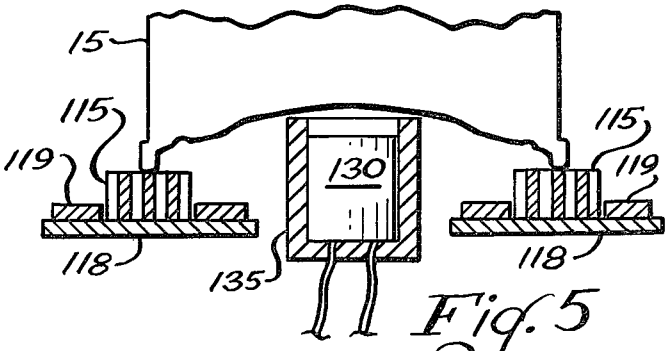
FIG. 5 is a mechanical schematic of the monitoring equipment.

Referring to the mechanical schematic of FIG. 5, the proximity sensor 130 is carried by the support bar 135 and spaced a predetermined distance beneath the can 15 bottom at the time of testing as determined by the specifications of the particular unit employed. A suitable unit has been found to be Model 1200 Dud Detector manufactured by Electro-Sonic Control of Manteca, Cal. The sensor 130 comprises a proximity detector generating an impulse from which the distance between the sensor and the can bottom may be determined for monitoring the pressure, either positive or negative, within the can. A variable voltage output signal from the proximity sensor 130 is measured by a threshold or level detector to monitor the distance between the sensor and a predetermined portion of the can bottom as controlled by the time-delayed signal from the can detector 131. When testing cans for a negative pressure, or vacuum, the can bottom will concave or spaced a distance from the sensor 130 greater than when the bottom is flat or when the negative pressure in the can is insufficient. The differential between two such signal levels, as determined by the threshold or level detector, will cause a reject signal to be generated whenever the signal from the proximity sensor 130 varies from the limits of the predetermined level. If the voltage signal from the sensor 130 is within the predetermined limits — indicating the presence of a proper vacuum within the can — a reject signal will not be generated and the can will continue to move across the transporter 100 on the transporter chains 115 passing into the mouth of the star-wheel indexer 121 at the exit of the transporter. Movement of the can through this indexing device will rotate the star-wheel indexer 120 at the entrance to the transporter allowing another can to enter for testing.

If the can being monitored has caused a reject signal to be generated, such a reject signal will energize a reject mechanism 140 for removing the defective can from further processing. The reject mechanism 140 is supported from one side of the transporter 100 by frame plate 109 and includes an electrical solenoid or pneumatically operated plunger 141 which when energized is rapidly and momentarily extended outwardly with sufficient force to remove a can passing along the transporter chains 115 into a reject chute 142. A time delay is provided between the generation of the reject signal and the operation of the plunger 141 to insure that the particular defective can is removed from the transporter 100. During enerization of the reject plunger 141 the upward biasing of the support bar 135 against the can bottom will insure that the plunge rod 141 will push the can from the transporter chains 115 without causing the can to become jammed in any part of the transport mechanism, but moves smoothly across the transporter into the reject chute 142. The reject chute 142 is inclined downward from the transporter 100 to a suitable container (not shown) for holding the defective cans.

While the invention has been described with reference to a preferred embodiment, it will be understood by those skilled in the art that various changes may be made and equivalent may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A transporter for controlling the movement of articles through a monitoring station whereat a parameter of each article is tested and those articles determined to vary from predetermined limits are removed from the transporter, comprising transport means including a pair of spaced transport chains movable in parallel endless paths of movement, support means positioned in contact with said transport chains forming a fixed support base therefore during a portion of movement in said endless path, guide means carried by said support means and positioned adjacent the path of movement of said transport chains to control lateral movement thereof, said transport means positionable on-line in a conveying system for transporting articles from an entrance position whereat the articles are conveyed from the conveying system to the transport means through an exit position whereat the articles are passed from the transport means to the conveying system, index means positioned adjacent said entrance position for controlling the spacing between articles being transported by said transport means, detecting means positioned adjacent said index means for detecting the presence of an article being transported by said transport means and producing a control signal in response to the presence of the article, monitoring means operatively connected to said detecting means and actuable in response to said control signal for testing a parameter of the articles and producing a command signal when the tested parameter varies from a predetermined limit, and reject means positioned adjacent said transport means and operatively connected to said monitoring means for actuation in response to said command signal to remove articles from said transport means when the tested parameter varies from the predetermined limits.

2. The apparatus of claim 1 further including index means positioned adjacent said exit position, and said exit position index means operatively connected to the index means positioned adjacent said transport means entrance position for simultaneous indexing to control the movement of articles by said transport means.

3. The apparatus of claim 1 wherein said reject means includes a reciprocably actuable plunger rod operable in response to said command signal to move an article laterally across said transport means, and chute means positioned adjacent said transport means opposite to said plunge rod for receiving articles removed from said transport means by said plunger rod.

4. The apparatus of claim 1 wherein said detecting means is adjustably positionable relative to said monitoring means for varying the relative position between an article and said monitoring means at the time of testing a parameter of the article in response to the relative position between said detecting means and said monitoring means.

5. The apparatus of claim 1 wherein said transport means further includes idler means positioned for receiving a conveying means of the conveying system between said pair of spaced transport chains to allow the operation of the conveying system independent of the transporting of articles by said transport means.

6. The apparatus of claim 1 wherein said monitoring means is carried by a support for pivotal movement into contact with an article being transported by said transport means providing a fixed spatial distance therebetween and stablizing the article during testing.

7. The apparatus of claim 6 wherein said monitoring means is adjustably positionable relative to said support for varying the spatial distance between said monitoring means and the article being monitored.

8. A transporter for controlling the movement of articles through a monitoring station whereat a parameter of each article is tested and those articles determined to vary from predetermined limits are removed from the transporter, comprising transport means positionable on-line in a conveying system for transporting articles from an entrance position whereat the articles are conveyed from the conveying system to the transport means through an exit position whereat the articles are passed from the transport means to the conveying system, index means positioned adjacent said entrance position for controlling the spacing between articles being transported by said transport means, detecting means positioned adjacent said index means for detecting the presence of an article being transported by said transport means and producing a control signal in response to the presence of the article, monitoring means operatively connected to said detecting means and actuable in response to said control signal for testing a parameter of the articles and producing a command signal when the tested parameter varies from a predetermined limit, reject means positioned adjacent said transport means and operatively connected to said monitoring means for actuation in response to said command signal to remove from said transport means wherein the tested paramenter varies from the predetermined limits, and index means positioned adjacent said exit position and operatively connected to the index means positioned adjacent said transport means entrance position for simultaneous indexing to control the movement of articles by said transport means, comprising a pair of rotatably supported star wheels, and each star wheel forming said pair being mechanically coupled to the other star wheel forming said pair for simultaneous rotational movement.

9. A transporter for controlling the movement of articles through a monitoring station whereat a paramenter of each article is tested and those articles determined to vary from predetermined limits are removed from the transporter, comprising transport means positionable on-line in a conveying system for transporting articles from an entrance position whereat the articles are conveyed from the conveying system to the transport means through an exit position whereat the articles are passed from the transport means to the conveying system, index means positioned adjacent said entrance position for controlling the spacing between articles being transported by said transport means, detecting means positioned adjacent said index means for detecting the presence of an article being transported by said transport means and producing a control signal in response to the presence of the article, monitoring means operatively connected to said detecting means and actuable in response to said control signal for testing a parameter of the article and producing a command signal when the tested parameter varies from a predetermined limit, reject means positioned adjacent said transport means and operatively connected to said monitoring means for actuation in response to said command signal to remove articles from said transport means when the tested parameter varies from the predetermined limits, and said monitoring means being carried by a support for pivotal movement into operative contact with an article being transported by said transport means providing a fixed spatial distance therebetween stabilizing the article during testing, and extending adjacent to said reject means for supporting an article during removal thereof by said reject means.

* * * * *

UNITED STATES PATENT AND TRADEMARK OFFICE

CERTIFICATE OF CORRECTION

PATENT NO. : 4,044,891

DATED : Aug. 30, 1977

INVENTOR(S) : Pynsky

It is certified that error appears in the above-identified patent and that said Letters Patent is hereby corrected as shown below:

Column 7, line 14, claim 8, after "remove" the word --articles-- has been omitted.

Column 7, line 22, claim 8, before "comprising" the phrase --each of said index means-- has been omitted.

Signed and Sealed this

Twenty-third Day of January, 1990

*Attest:*

JEFFREY M. SAMUELS

*Attesting Officer*

*Acting Commissioner of Patents and Trademarks*